US005396268A

United States Patent [19]

Mader et al.

[11] Patent Number: 5,396,268

[45] Date of Patent: Mar. 7, 1995

[54] REFILL APPARATUS AND METHOD

[75] Inventors: Rodney G. Mader, Dayton; John C. Loyd, Centerville; Russell L. Bartley, Urbana, all of Ohio

[73] Assignee: Scitex Digital Printing, Inc., Dayton, Ohio

[21] Appl. No.: 853,926

[22] Filed: Mar. 27, 1992

[51] Int. Cl.[6] ..... B41J 2/175

[52] U.S. Cl. ..... 347/7; 347/85

[58] Field of Search ..... 347/7, 19, 85, 86, 84

[56] References Cited

U.S. PATENT DOCUMENTS 3,761,953 9/1973 Helgeson et al. ..... 347/7
4,301,459 11/1981 Isayama et al. ..... 347/19
4,475,116 10/1984 Sicking et al. ..... 347/7 Y
4,940,997 7/1990 Hamlin et al. ..... 347/7 Y

*Primary Examiner*—Joan H. Pendegrass
*Attorney, Agent, or Firm*—Barbara Joan Haushalter

[57] ABSTRACT

A system and method for emptying a refill container used in a continuous ink jet fluid system reduces the amount of ink left in the refill container and eliminates adverse effects in the event that air enters the fluid system through the refill apparatus. The system for emptying the container includes a system vacuum and a refill container. A bi-directional path is provided between the system vacuum and the refill container. The air is then removed from the refill container while maintaining the system vacuum within a predetermined range.

10 Claims, 3 Drawing Sheets

REFILL APPARATUS AND METHOD

TECHNICAL FIELD

The present invention relates to continuous ink jet printers and, more particularly, to a refill system and method for refilling fluid into a continuous ink jet fluid system.

BACKGROUND ART

Ink jet printing systems are known in which a print head defines one or more rows of orifices which receive an electrically conductive recording fluid from a pressurized fluid supply manifold and eject the fluid in rows of parallel streams. Printers using such print heads accomplish graphic reproduction by selectively charging and deflecting the drops in each of the streams and depositing at least some of the drops on a print receiving medium, while others of the drops strike a drop catcher device.

One traditional method of refilling fluid into a continuous ink jet fluid system was to use a simple, collapsible, refill container. This method relies on the system vacuum to squeeze ink out of the container. However, when the system vacuum has squeezed all of the ink that it can out of the container, the container still has a significant volume of fluid remaining in the neck, due to the inability to completely collapse the bottle at that location. This poses several problems. First, disposing of bottles still containing some volume of ink creates environmental safety issues. Another problem is that any amount of unused ink obviously results in some unrecovered cost of the refill fluid.

In an attempt to solve these problems associated with fluid remaining in the neck of a bottle, it would seem logical to put a tube in the bottle, extending from the cap to the bottom of the bottle. In this way, theoretically, ink will drain to the bottom of the bottle, so the application of the vacuum source there should be able to remove more ink. Unfortunately, a new problem was encountered with this method. As the ink is removed from the container, a vacuum is created at the top of the bottle which opposes the vacuum trying to remove the ink. Therefore, when the two vacuum levels are equal, removal of ink will cease and, again, a significant amount of ink is left in the refill container.

Thus far, removal of ink from the refill container assumed the restriction of relying on the fluid system for the vacuum source supplied during normal continuous ink jet operation. One possible fluid refill method relieves this restriction in an attempt to remove as much ink as possible from the refill bottle. In this method, the top of a non-collapsible refill container is vented to atmosphere, with the tube still extending to the bottom of the bottle. While this method eliminates the vacuum lock problem, it still does not remove all of the ink from the container because now the position of the tube relative to the last remains of ink in the container becomes important. And the optimum position of the tube relative to the last remains of ink is not achievable without the undesirable effect of increasing the cost of the container.

It is seen then that there is a need for a refill system and method which eliminates the environmental, as well as the cost inefficiency, concerns of emptying fluid refill containers.

SUMMARY OF THE INVENTION

This need is met by the system according to the present invention, wherein a collapsible container with a tube is vented, thereby significantly reducing the amount of ink left in the emptied container. This leaves such a negligible amount of ink in the container that environmental and cost inefficiency concerns are eliminated.

In accordance with one aspect of the present invention, a continuous ink jet imaging system comprises a means for providing a system vacuum for a constant fluidic system and a means for detecting the system vacuum and providing a signal in response thereto. The system further comprises a means for containing a refill fluid and a means for providing a bi-directional path. The bi-directional path is provided in one direction between the means for providing a system vacuum and the means for containing a refill fluid, and in the other direction between atmosphere and the means for containing a refill fluid. Finally, the system comprises a control means for removing air in the means for containing a refill fluid while maintaining the system vacuum within a predetermined range.

Accordingly, it is an object of the present invention to provide a refill system and method for emptying a refill container. Other objects and advantages of the invention will be apparent from the following description, the accompanying drawings and the appended claims.

DETAILED DESCRIPTION OF THE PREFERRED EMBODIMENTS

The present invention provides a system and a method for emptying a refill container for an ink jet fluid system, where a critical fluid vacuum source is used to draw from the refill system. It has been assumed in the prior art that inducing a significant volume of air into the normal operation of a fluid system is undesirable because the normal operation requires a minimum vacuum level to maintain proper printhead function. The present invention successfully deals with air in the refill container to reduce the amount of ink left in the refill container and to eliminate adverse effects in the event that air enters the fluid system through the refill apparatus.

Figure 1:
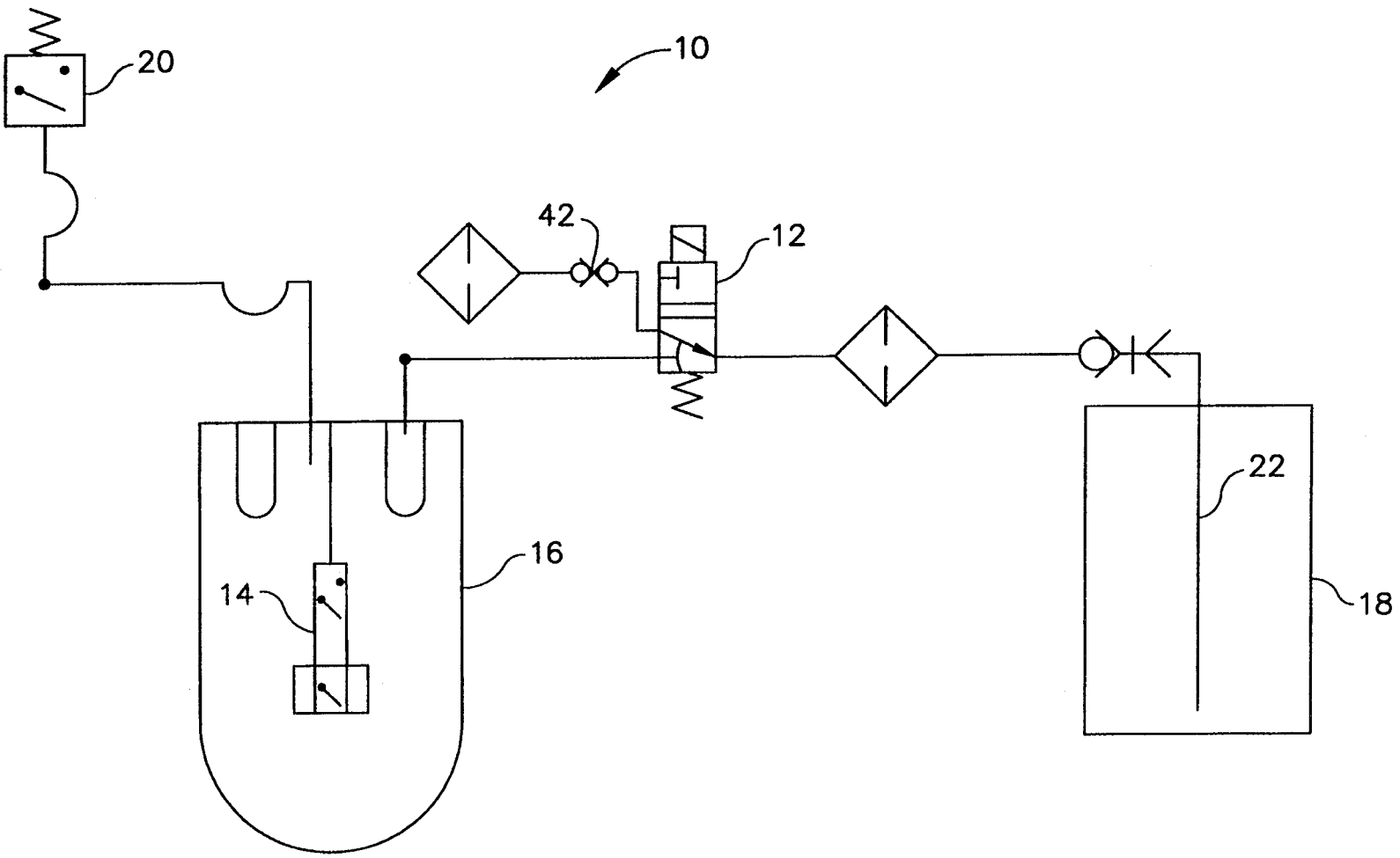
FIG. 1 is a block diagram illustrating components of a continuous ink jet fluid system.

Referring now to the drawings, in FIG. 1 a block diagram illustrates a refill system 10 associated with and comprised of components of a continuous ink jet fluid system. The refill system 10 includes a 3-way solenoid valve 12 and a float switch 14. When the float switch 14 determines that the system 10 does not require ink from the ink tank 16, the 3-way solenoid valve 12 provides a path for venting a refill container 18. This venting helps reduce the amount of ink (or other fluid) remaining in the refill container 18. When it is determined that the system 10 requires ink to be added, the 3-way solenoid valve 12 is energized and a vacuum originating from normal continuous ink jet fluid system operation. A vacuum switch 20 pulls ink from the bottom of the refill container 18 into the tank 16.

Continuing with FIG. 1, under these normal conditions, there are no further requirements placed on the fluid system. However, when the refill container 18 becomes emptied to the point where it nears the end of a tube 22, insertable in the container 18, there will suddenly be a surge of air towards the fluid system vacuum source, which includes the vacuum switch 20. Essentially, the refill container 18 is now at atmospheric pressure, i.e., near empty. Therefore, the fluid system will attempt to pull significantly more air from the refill system 10 than through the normal fluid system/printhead path.

Figure 2:
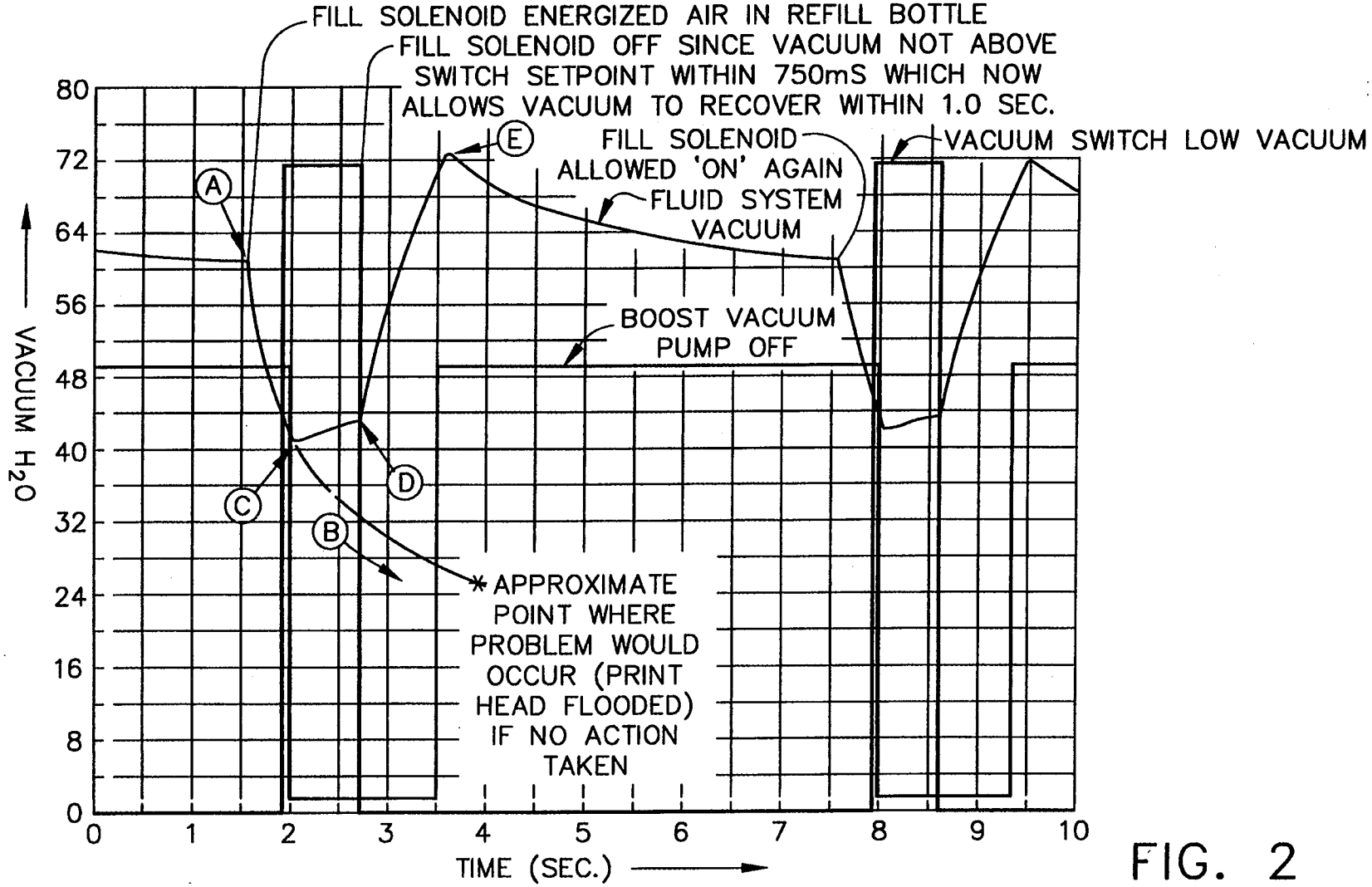
FIG. 2 is a timing diagram for the operation of the refill system and method of the present invention.

Referring now to FIG. 2, and continuing with FIG. 1, the situation described above will create a drop in the fluid system vacuum, as illustrated in FIG. 2 at point A. At point A, it is beneficial to concentrate on compensating for the adverse effects in the event that air enters the fluid system through the refill container 18. In order to achieve this, the fluid system has been improved to include an air purge routine 24, illustrated in the flowchart of FIG. 3, through which the fluid system continually runs. The system begins at start block 26 and continues to decision block 28, where the system vacuum switch 20 is normally monitored to produce an error and halt continuous operation when there is a drop in the system vacuum below a setpoint. If no low vacuum condition exists, the program continues to block 29, where a refill solenoid 12 is energized and the refill system 10 draws ink, as required, by the float switch 14. When there is low vacuum in the fluid system, the air purge loop 24 continues to decision block 30. At decision block 30, the state of the refill solenoid 12 is determined. If the state of the solenoid 12 is on and the low vacuum condition exists, then the drop in vacuum is likely caused by air being pulled from the refill container 18. The fluid system boost vacuum pump, typically available in ink jet fluid systems to provide higher vacuum during start-ups, is energized at block 32 in an attempt to recover from vacuum loss. The boost vacuum is then kept energized at block 32 for a fixed time, as discussed below.

Figure 3:
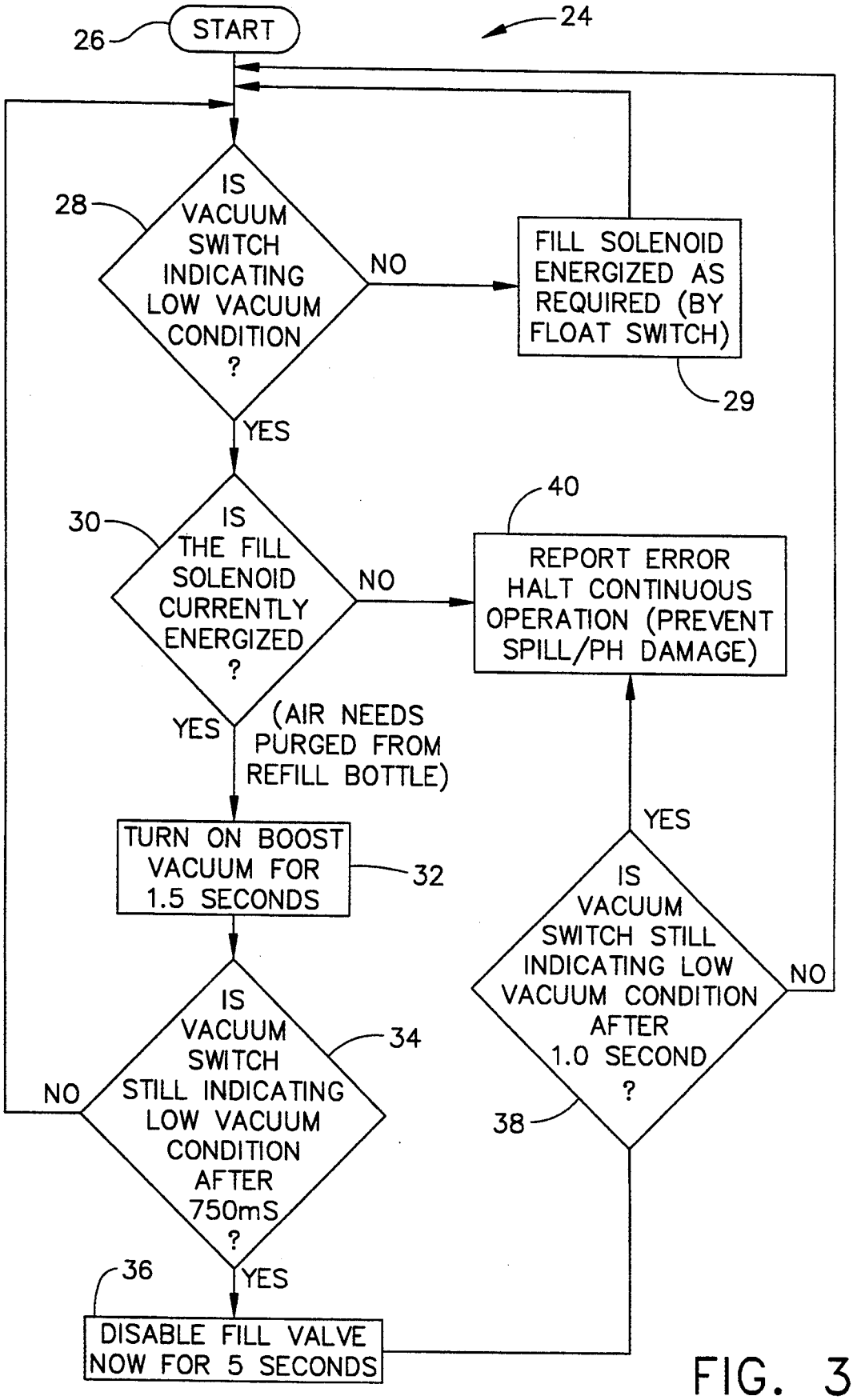
FIG. 3 is a flow chart for accomplishing refill container air purge.

Continuing with FIG. 3, if no action were taken in response to the low vacuum condition determined at block 28, the vacuum would continue to drop, as air continues to be purged from the refill container 18, to the point where proper fluid system function would cease, as shown in FIG. 2 at point B. With the present invention, it can be determined when the fluid system vacuum would reach point B, and prevent that from occurring. The first attempt to recover the vacuum lost is at block 32, as described above, which corresponds to point C in FIG. 2. The advantage of using the boost vacuum at block 32 is that it provides two benefits. First, it halts the drop of vacuum and can begin recovery. Second, while it maintains or raises system vacuum, it also is pulling air from the refill container 18 and continuing to collapse the container 18. The time selected for the boost vacuum pump to be on is 1.5 seconds, which is based on a maximum time on and a minimum recover time, as discussed below.

Meanwhile, the vacuum level may still be below the switch 20 setpoint and continuing to indicate low vacuum condition. Therefore, another stage of recovery is necessary, as indicated at decision block 34. It is determined at decision block 34 whether the vacuum switch 20 is still indicating a low vacuum condition after a predetermined period of time, such as 750 milliseconds, based on information from point B in FIG. 2. The action of the second stage of recovery is to close the refill solenoid 12 as shown in FIG. 2 at point D, and the flowchart 24 of FIG. 3. This will cause more immediate recovery since the fluid system is now back to normal, and the boost vacuum at block 32 still on.

If the second stage of recovery is reached, the fill solenoid 12 is disabled for a predetermined period of time, such as five seconds, at block 36, to allow the possible overshoot from the boost vacuum to settle near normal system vacuum level. Point E in FIG. 2 illustrates the point where the boost vacuum time expires. The time for the fill valve 12 disable is simply chosen to be a sufficient time for the fluid system to return to near stable normal operation before allowing the loop 24 to repeat. Finally, after the fill valve 12 disable time expires, the system is approximately normal and the entire loop 24 is allowed to be repeated as often as necessary to collapse the refill container 18.

When the air purge loop 24 runs through its cycle, more air should be extracted from the container 18 during valve 12 open time than is allowed to enter the container 18 during valve 12 close time. This is accomplished by accurately selecting an orifice or restrictor 42, shown in FIG. 1. If the orifice 42 is too large, the loop 24 will create an artificial lung which will continuously 'breathe', preventing collapse of the refill container 18. The orifice 42, then, should be as large as allowable to prevent other problems, such as high air filtration requirements and clogging concerns. A typical orifice 42 size is 0.012 inches.

Continuing with FIG. 3, the maximum time allowed to endure the low vacuum condition is selected based on the time where the fluid system would fail if no action were taken or if the boost vacuum pump would fail. The time where low vacuum becomes a problem is approximately two seconds after the switch 20 has detected a low vacuum. Therefore, the maximum allowed time to endure the low vacuum condition is safely chosen to be approximately one second, as indicated at decision block 38. Therefore, if the loop 24 is failing and cannot recover vacuum, the fluid system will correctly halt continuous operation, as indicated at block 40, wherein continuous operation is halted in such a situation in time to prevent ink spill and ink jet printhead damage.

The time allowed to endure low vacuum and continue to purge air from the container 18 is based on the maximum allowed time to endure low vacuum, minus some margin of safety from the time the rapid vacuum recovery occurs, once the refill valve 12 was closed. Based on the one second maximum at decision block 38, the time allowed to keep the fill valve 12 on may safely be chosen to be 750 milliseconds, as indicated at decision block 34. Naturally, this time is desired to be as long as possible in order to purge as much air out of the refill container 18 as possible for each repetition of loop 24.

As explained above, the boost vacuum is turned on for approximately 1.5 seconds at block 32, which includes the one second maximum low vacuum endurance plus a recover time, since it is desired to actually recover to normal operating vacuum and not merely to the switch vacuum level. The boost vacuum on time cannot be too long, however, because it is undesirable to overshoot the normal vacuum level significantly. For example, when normal system vacuum level is sixty inches of water, as shown in FIG. 2, maximum vacuum should be considered to be approximately 90 inches of water, to prevent print quality degradation problems.

Industrial Applicability and Advantages

The present invention is useful in the field of ink jet printing, and has the advantage of maximizing removal of fluid from a refill container. Previous methods for emptying refill containers leave anywhere from 50 ml to 350 ml of fluid in a 1500 ml container, whereas the system and method of the present invention can reduce that amount to less than 10 ml. This is such a negligible amount that it provides the advantages of alleviating environmental concerns associated with disposing partially empty refill containers, and increasing cost efficiencies.

Having described the invention in detail and by reference to the preferred embodiment thereof, it will be apparent that other modifications and variations are possible without departing from the scope of the invention defined in the appended claims.

What is claimed is:

1. A continuous ink jet imaging system comprising:

a means for providing a system vacuum for a constant fluidic system;

a means for containing a refill fluid;

a means for providing a bi-directional path associated with the constant fluidic system;

a means for detecting the system vacuum and providing a signal in response thereto; and a control means for removing air in the means for containing a refill fluid while maintaining the system vacuum within a predetermined range.

2. A continuous ink jet imaging system as claimed in claim 1 wherein the means for containing a refill fluid is a collapsible refill container.

3. A continuous ink jet imaging system as claimed in claim 2 wherein the collapsible refill container will support removal of fluid from a bottom of the collapsible refill container with atmospheric pressure residing at a top of the collapsible refill container.

4. A continuous ink jet imaging system as claimed in claim 1 wherein the means for containing a refill fluid comprises:

a container;

a means for drawing fluid from a bottom of the container; and a means for allowing the container to collapse when the container is substantially empty, to facilitate complete emptying.

5. A continuous ink jet imaging system as claimed in claim 1 wherein the bi-directional path comprises a first path between the means for providing a system vacuum and the means for containing a refill fluid and a second path between atmosphere and the means for containing a refill fluid.

6. A method for emptying a refill container in a continuous ink jet imaging system comprising the steps of:

providing a system vacuum for a constant fluidic system;

providing a means for containing a refill fluid;

providing a bi-directional path associated with the constant fluidic system;

detecting the system vacuum and providing a signal in response thereto; and removing air in the means for containing a refill fluid while maintaining the system vacuum within a predetermined range.

7. A method for emptying a refill container in a continuous ink jet imaging system as claimed in claim 6 wherein the means for containing a refill fluid is a collapsible refill container.

8. A method for emptying a refill container in a continuous ink jet imaging system as claimed in claim 7 wherein the collapsible refill container will support removal of fluid from a bottom of the collapsible refill container with atmospheric pressure residing at a top of the collapsible refill container.

9. A method for emptying a refill container in a continuous ink jet imaging system as claimed in claim 6 wherein the means for containing a refill fluid comprises:

a container;

a means for drawing fluid from a bottom of the container; and a means for allowing the container to collapse when the container is substantially empty, to facilitate complete emptying.

10. A method for emptying a refill container in a continuous ink jet imaging system continuous ink jet imaging system as claimed in claim 6 wherein the bi-directional path comprises a first path between the means for providing a system vacuum and the means for containing a refill fluid and a second path between atmosphere and the means for containing a refill fluid.

* * * * *